US005918776A

United States Patent [19]

Atkinson

[11] Patent Number: 5,918,776

[45] Date of Patent: Jul. 6, 1999

[54] METERED DISPENSING CAP SYSTEM

[76] Inventor: Al Atkinson, 1537 Molly Cir., Oceanside, Calif. 92054

[21] Appl. No.: 09/006,055

[22] Filed: Jan. 12, 1998

[51] Int. Cl.[6] ..... B67D 37/00

[52] U.S. Cl. ..... 222/207; 222/527

[58] Field of Search ..... 222/207, 527, 222/449

[56] References Cited

U.S. PATENT DOCUMENTS

| | | | |
|---|---|---|---|
| 2,802,604 | 8/1957 | Ebberts | 222/207 |
| 2,815,890 | 12/1957 | Cooprider et al. | 222/207 |
| 2,824,672 | 2/1958 | Wersching | 222/207 |
| 5,184,760 | 2/1993 | Weinstein et al. | 222/207 |
| 5,829,640 | 11/1998 | Hershey et al. | 222/207 X |

*Primary Examiner*—Gregory L. Huson
*Attorney, Agent, or Firm*—John J. Murphey

[57] ABSTRACT

The invention is a metered dispensing cap system for containers of medicinal salve, comprising a stiff base element of finite thickness and defined by an outer perimeter threadably attachable to the externally threads located about the neck of a collapsible tube of medicinal salve, and having an opening formed in the base element and an opening formed in the neck of the collapsible tube, the openings arranged in mutual axial alignment, for outflow of salve from the tube, a one-way valve located in the base element at the aligned openings permitting flow of salve from the collapsible tube through the openings and preventing backflow thereof into the tube; and, a meter element comprising a manually collapsible chamber formed of a thin, flexible chamber wall directly attached to the base element, about the perimeter and covering over the one-way valve, to hydraulically seal the chamber from outside thereof, the chamber adapted to receive therein salve squeezed from the tube, through the one-way valve, and containment of the salve therein, and, an elongated spout communicably engaged at one end to the chamber and having a second, distal end spaced-apart therefrom for delivery of the salve from the chamber upon manual collapsing of the chamber, wherein the chamber and the spout have a combined internal volume at least equal to the volume of the dose of medicinal salve passed from the tube through the chamber and spout to the recipient of the salve.

24 Claims, 3 Drawing Sheets

METERED DISPENSING CAP SYSTEM

BACKGROUND OF THE INVENTION

1. Field of the Invention

This invention pertains to the field of containerized materials. More particularly, it pertains to a dispensing cap system for use with tubes and other squeezable containers of viscous or non-Newtonian material, such as ointments, salves and balms, to dispense them in an accurate and easily handled manner.

2. Description of the Prior Art

The use of ointments, salves and balms on cuts, scratches and burns is a matter of historical note. There is not a person living today that has not had an injury treated with a petroleum jelly-based material. As medicine progresses, we find that petroleum jelly and other like substances are used to apply more sophisticated medicines, such as antibiotics and steroids, as treatment for a wide variety of ills. In the field of pharmacology, ointments, salves and balms, carrying a wide variety of these medicines, old and new, are being used to cure or alleviate the symptoms of ear infections and other maladies where the material must be applied in a specific amount and at a specific location.

In the field of veterinary science, application of petroleum-based medicines are important in the treatment of ear infections, eye infections, and the like where specific amounts of material must be applied in a controlled time-sequence so that the treatment is efficient as well as effective. In some cases these medicines are expensive and if used in too large an amount constitutes a waste of the medicine as well as a waste of money. It is important therefore to be able to provide the appropriate amount of a medicine at a specific location so that medicine is not wasted and the results of the treatment justify the cost involved.

Specifically, small tubes of ointment are often prescribed to a patient for treatment of a malady such as an ear infection. It is virtually impossible to control or measure the amount of ointment to be applied even if the amount was known to the treater beforehand. Often too much ointment is used with the result that the tube is used up too fast and another tube must be procured. With certain medicines the cost per tube is great so that the inability to measure the amount results in a significant waste of money.

Further, in certain cases, such as in farm animals, it is inappropriate to take the tube or squeezable container to the field to treat the animal because of the chance that the tube will be dropped, stepped on, or otherwise contaminated. It would be more efficient to be able to take a dose of the material out to the field and apply it free of the basic supply tube.

The prior art has tried to deal with this problem, however, no clear path of success has been achieved. Basically, the prior art has provided caps that fit over squeezable bottles of liquids or balms and have a volumetric measure in the form of a cup that is mounted on the cap in a sliding connection. The bottle is squeezed and it is hoped that the liquid contents will exit the bottle and fill the cup. The cup must be then removed from the bottle and somehow emptied into another container, such as a glass or cup, to be thereafter given to the person or animal as treatment. In one case, a piston is reciprocally positioned in a device mounted above the squeezable tube and is driven upward by material flowing or squeezed from the container, to be later squeezed by pressing down on the piston to drive the material out a small hole in the side of the device. However, such a device is comprised of numerous parts that must be assembled thus making the device expensive. The piston tends to leak thus making the device potentially messy. U.S. Pat. Nos. 3,734,350, 4,875,603 and 5,184,760 are examples of these prior art practices.

SUMMARY OF THE INVENTION

This invention is a method of dispensing thick or viscous materials from squeezable containers or tubes. In one embodiment, the material can be applied a few inches from the carrying tube. The invention is small, easy to use, extremely inexpensive, and can take a lot of abuse.

The invention is a metered dispensing cap system for containers of medicinal salve, comprising a stiff base element of finite thickness and defined by an outer perimeter threadably or otherwise attachable to the external threads located about the neck of a collapsible tube of medicinal salve, and having an opening formed in the base element and an opening formed in the neck of the collapsible tube, the openings arranged in mutual axial alignment, for outflow of salve from the tube, a one-way valve located in the base element at the aligned openings permitting flow of salve from the collapsible tube through the openings and preventing backflow thereof into the tube; and, a meter element comprising a manually collapsible chamber formed of a thin, flexible chamber wall directly attached to the base element, about the perimeter and covering over the one-way valve, to hydraulically seal the chamber from outside thereof, the chamber adapted to receive therein salve squeezed from the tube, through the one-way valve, and containment of the salve therein, and, an elongated spout communicably engaged at one end to the chamber and having a second, distal end spaced-apart therefrom for delivery of the salve from the chamber upon manual collapsing of the chamber, wherein the chamber and the spout have a combined internal volume at least equal to the volume of the dose of medicinal salve passed from the tube through the chamber and spout to the recipient of the salve. and apply them at locations apart from the container. In another embodiment, the material can be charged to the dispenser, the dispenser separated from the filling tube and carried some distance and the application made at that distant location.

Accordingly, the main object of this invention is a device for use with ointments, balms and salves that is convenient to use and that provides for easy and efficient application of the material from a storage tube or bottle to the patient in a proper dose. Other objects of the invention include a device that makes dosage of medicine materials more accurate so that the treatment is made more efficacious and at less cost than in the prior art; a device that is easily attachable to containers of thick medicines that are to be applied to a patient in doses that are closely controlled; a device that is cheap to make and easy to use; a device that is useable with a wide variety of materials; a device that is applicable to humans as well as animals; and a device that is useable by persons of limited education so as to be available to third world countries.

These and other objects of the invention will become more apparent by reading the following Description of the Preferred Embodiment taken together with the drawings that are appended hereto. The scope of protection sought by the inventor may be gleaned from a fair reading of the claims that conclude this specification.

DESCRIPTION OF THE PREFERRED EMBODIMENTS

Figure 1:
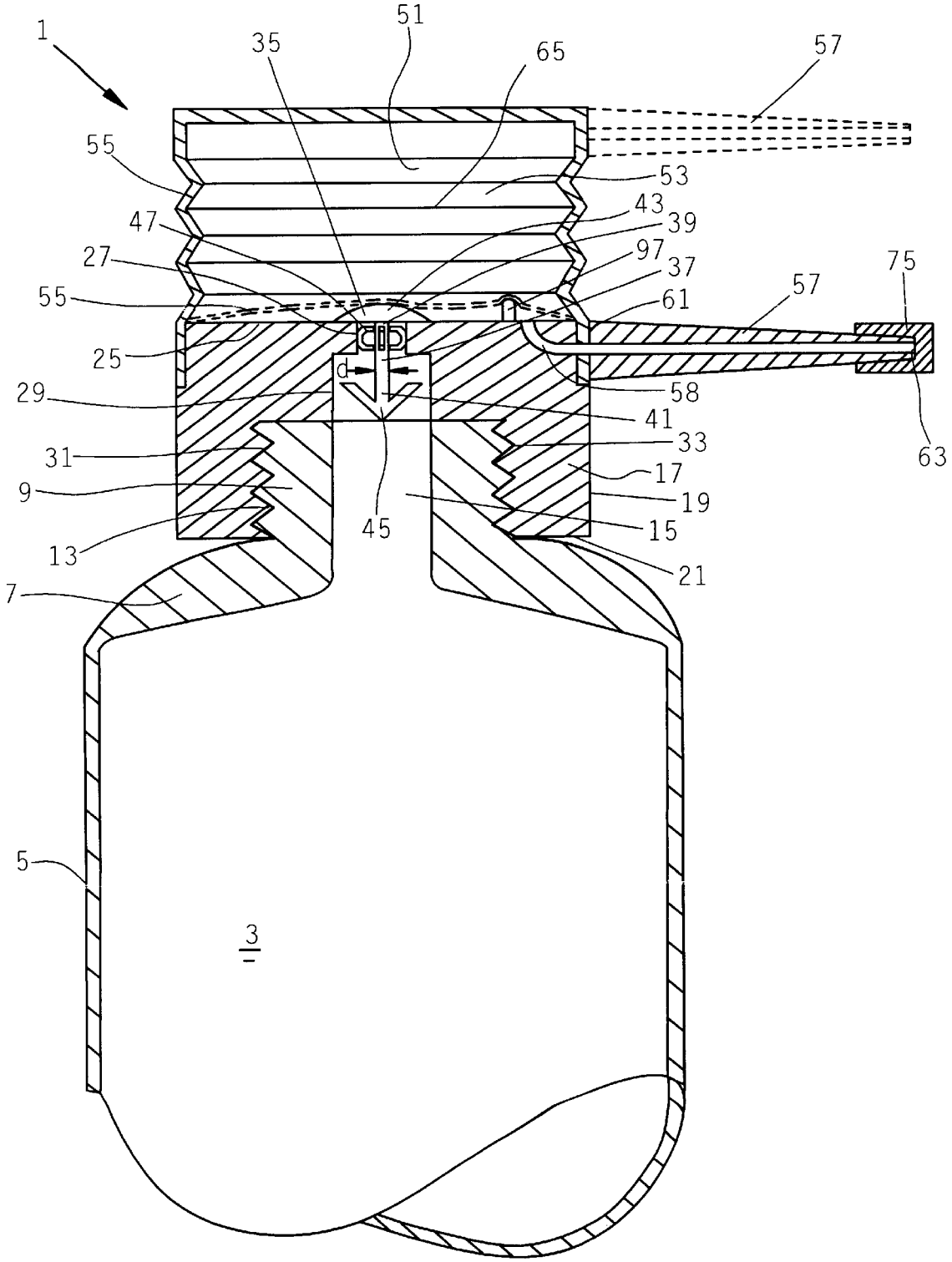
FIG. 1 is a sectional side view of the preferred embodiment of this invention.

Turning now to the drawings where elements are identified with numbers and like elements are identified with like numbers throughout the seven Figures, FIG. 1 shows one aspect of the preferred embodiment of this invention and shows a metered dispensing cap system 1 for containers 3. Containers 3 that are useful with this invention comprise a squeezable or collapsible side wall 5 terminating in an upper end wall 7 in the form of a frusto-conical configuration having a central boss or neck 9 formed therein having a series of threads 13 formed thereabout and having a first bore or hole 15 centrally located axially therethrough.

Metered dispensing cap system 1 of this invention is shown in FIG. 1 to comprise a base element 17, made of plastic or other stiff material, of finite thickness such as one-half to one inch thick, and defined by an outer perimeter 19, that may be knurled for better grip. Base element 17 is further defined by a bottom wall 21 and a top wall 25, and a vertical channel or second bore 27 preferable centrally located therethrough from top wall 25 toward bottom wall 21. A third bore 29 is formed inward from base element bottom wall 21 and is preferrably of a diameter at least as large as first and second bores 15 and 27. A fourth bore 31 is formed inward from bottom wall 21 and has a series of threads 33 are formed on the interior surface thereofof for threadeble connection with threads 13 on container neck 9. Bores 15, 27 and 29 have smooth interior surfaces to facilitate the passage of ointment, salve or balm from tube 3 into base element 17. And, importantly, bores 15, 27, 29 and 31 are all preferrably arranged in mutual axial alignment, as shown in FIG. 1, so that they do not impede the flow of material from container 3 into cap system 1.

Figure 2:
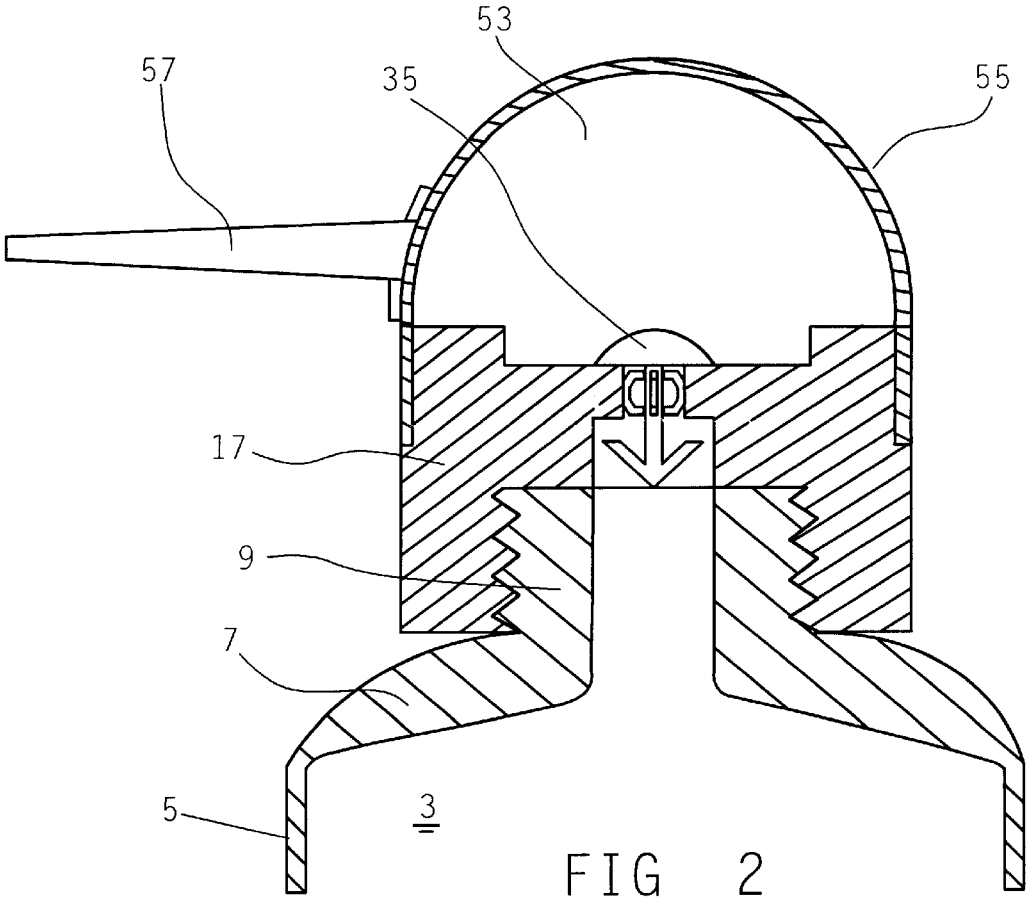
FIG. 2 is a sectional side view of another embodiment of the invention.

A one-way valve 35 is provided in aligned bores 15 and 27, as shown in FIG. 1, to allow flow of material from container 3 into cap system 1 but not to allow any backflow of the material in the other direction. The preferred embodiment of one-way valve 35 is shown in FIGS. 1 and 2 and show it to comprise a shaft 37 of terminal length, defined by top and bottom distal ends 39 and 41 respectively, and of a diameter "d" less than the inside diameters of bores 15 and 27. Shaft 37 is arranged for reciprocal motion up and down in bores 15 and 27. A valve head 43, comprising a bulbous portion, is formed at upper distal shaft end 39 and arranged for movement with shaft 37 upward, to uncover bore 15 and allow a flow of material from container 3 into base element 17, and, later, downward movement to bring head 43 into contact with bore 15 to seal it off from backflow of material from base element 17 down into container 3. A non-sealing fitting 45 is formed at bottom distal shaft end 41 for movement with shaft 37 to prevent shaft 37 from being swept upward, out of bores 15 and 27, by movement of the viscous ointment, salve or balm from container 3 up into base element 17.

As shown in FIG. 1, non-sealing fitting 45 is in the form of a narrow arrow head that allows passage of material out of container 3 up through aligned bores 15 and 27. The arrow head design is only typical of the many designs available and is preferred to allow fitting 45 to be pressed downward through second bore 27 when cap system 1 is mounted on container 3. Valve 35 is preferred to be made of pliant plastic to allow easy withdrawal thereof when cap system 1 is withdrawn from container 3. A plurality of guide vanes 47 are provided and mounted on shaft 37 to maintain shaft 37 along the central axis x—x of first bore 15. Valve 35 may be conveniently made by injection molding techniques.

A meter element is shown generally in FIG. 1 at 51 and comprises a manually collapsible chamber 53 formed of a thin, flexible chamber wall 55 that is directly attached to base element 17, preferrably about outer perimeter 19, and covering over one-way valve 35 to hydraulically seal chamber 53 from the outside thereof. In the preferred embodiment chamber wall 55 is in the form of a bellows. In other cases within the scope of this invention, such as is shown in FIG. 2, chamber 53 may be hemispherical in shape or take on some other shape. Upon squeezing container 3, material would be forced up through container neck 9, through one-way valve 35 and into chamber 53 to fill it for later dispensing.

Chamber wall 55 should be made of a flexible material having the property of rebounding to its original shape after it is collapsed to exude the medicine from chamber 53. An elongated spout 57 is provided having a first distal end 61 communicably engaged to chamber 53 as shown in FIG. 1 and having a second distal end 63, spaced-apart from first distal end 61, for delivery of the material from chamber 53 upon manual collapsing of chamber 53 as shown in dotted outline in FIG. 1. Spout 57 is preferrably made of plastic that is stiff yet bendable. Examples of plastics usable herein are polyvinyl chloride, polyethylene, and the like. Manual collapsing of chamber 53 is done by pressing downward on chamber wall 55 with one's thumb toward base element 17 to force the material through spout 57. In FIG. 1, a collapsed chamber wall 55 is shown in dotted outline.

Figure 3:
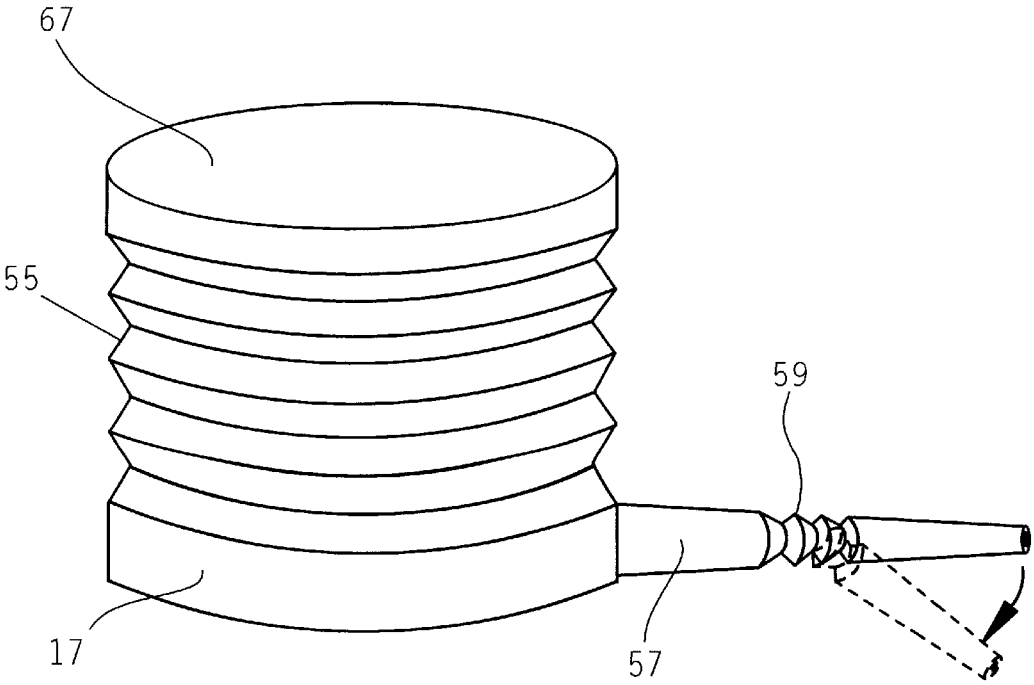
FIG. 3 is a perspective view of the preferred embodiment of the chamber of this invention.
Figure 4:
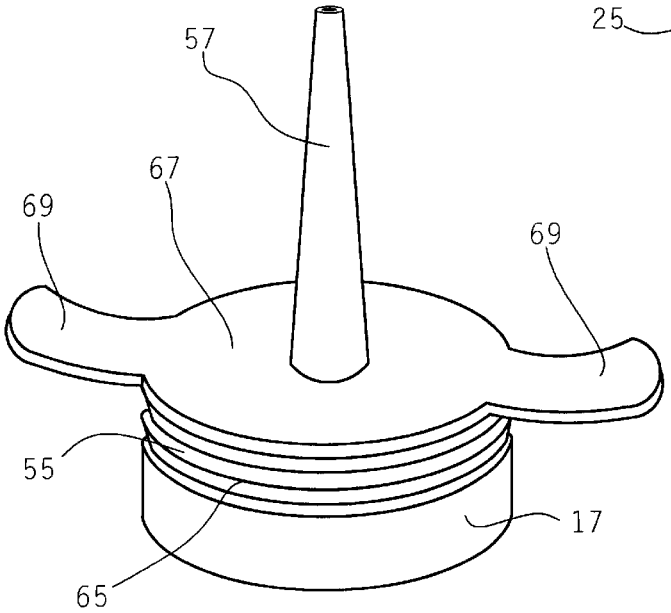
FIG. 4 is an illustrative view of another embodiment of this invention, having a bellows chamber shown in a collapsed condition.

Spout 57 can be attached to chamber 53 in just about any place desired. As shown in FIGS. 1 and 3, spout 57 is attached in communicable engagement at base element 17 through a short passageway 58. In FIG. 1 there is also shown in dotted outline spout 57 attached to chamber wall 55 somewhere on said wall. As shown in FIG. 2, spout 57 is attached to a hemispherical chamber wall. In FIG. 4, chamber wall 55 is in the form of a bellows and is shown collapsed such as after a dose of material in chamber 53 has been exuded from spout 57. In this Figure, spout 57 is shown to extend straight outward from the top end 67 of said bellows. Further, this embodiment is also shown to incorporate a pair of finger supports 69 extending outward a short distance, one from each side of bellows top end 67, for temporary receipt thereon of the index and middle fingers of the hand of the party dispensing the material.

Figure 5:
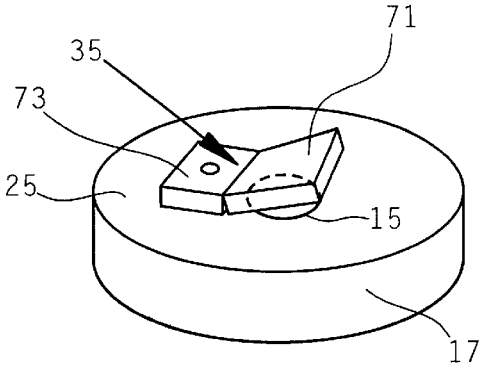
FIG. 5 is a partial view of the base element showing a different embodiment of the one-way valve in the open configuration.
Figure 6:
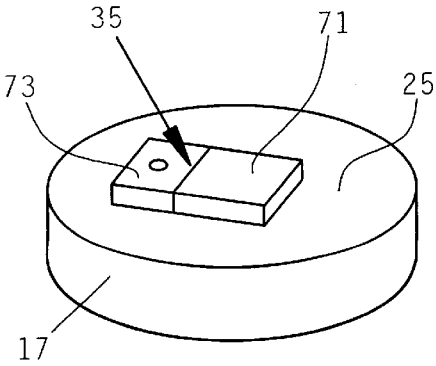
FIG. 6 is the same view as that of FIG. 5 except the one-way valve is shown in the closed configuration; and, FIG. 7 is a side view of still another embodiment of the invention.

In FIGS. 5 and 6 are shown another embodiment of one-way valve 35. In this embodiment a flap 71 is hingedly affixed with another riveted mounting flap 73 over the opening of first bore 15. As is known in the plastics art, two flaps of plastic material can be made such that one flap imparts a bias to the other flap in virtually any direction desired. In this particular embodiment, flap 71 is biased into a closed relationship over bore 15 to be bent upward under pressure from the exuding material coming from squeezable container 3 and to be biased downward under pressure from mounting flap 73 to shut off bore 15 and prevent escape of material from chamber 53. Biased movability of flap 71 vis-a-vis flap 73 can be imparted by forming a crease between the two flaps or by merely scoring one flap with a sharp object.

As shown in FIG. 3, spout 57 may include a bellows-like configuration 59 or other bendable configuration over a short distance to allow for bending (shown in dotted outline) of said spout from a straight line. This would be useful where the medicine must be dispensed in an animal's ear where a straight line thereinto is not possible or to allow it to bend with patient's movement during administration of the medicine.

Shown in FIG. 1 is a small cap 75 for positioning over the distal end of spout 57 to keep said end clean and free from dirt, dust and the attack of insects that may be drawn by the odor of the medicine.

It is noteworthy that this invention works best where the combined internal volume of chamber 53 and spout 57 is at least equal to the volume of the dose of material passed from squeezable container 3 through chamber 53 and spout 57 into the patient. In this manner, no material is wasted and all or virtually all of the material exuded into chamber 53 is used allowing little if any to remain to become contaminated.

Figure 7:
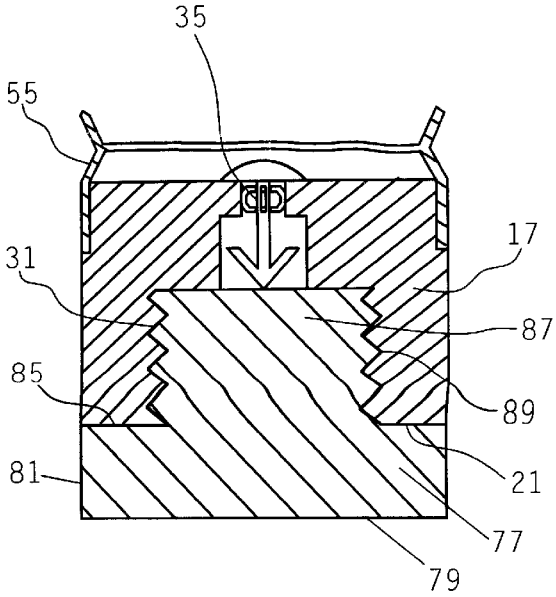

As shown in FIG. 7, another embodiment of this invention includes the provision of a blank 77 for removeable attachment to bottom wall 21 of base element 17, in place of container 3, to allow for transporting meter dispensing cap system 1 from the place of filling to a distant location, such as in the field, for application of the medicine apart from the place of filling. In this embodiment, blank 77 comprises a base wall 79, a side wall 81 extending upward from the perimeter of said base wall to a top wall 85 that has formed thereon an upwardly directed boss 87 having a series of threads 89, or other attachment provision such as a well-known snap fitting, formed thereabout for receipt in fourth bore 31 of base element 17. After chamber 53 is filled from squeezable container 3, it is separated therefrom and blank 77 is screwed into its place to provide cap system with a truly portable dispensing system.

Chambers 53 on the various embodiments may be filled in a variety of ways. The principal is to fill the chamber with the material from squeezable container 3 without entraining any bubbles of air therein. Bubbles of air take the place of material and thus lower the total dosage of material dispensed through this unique system. In loading or filling chamber 53, one should attempt to keep spout 57 pointed upward so that it is the last to be filled. As shown in FIG. 1, in some cases, especially where spout 57 is located in base element 17, it is preferred to provide a small baffle 97 adjacent the opening of first bore into chamber 57 to force the material away from the entrance into spout 57. This aids in preventing bits of the material from passing into spout 57 until the balance of chamber 53 is filled and prevents bubbles from forming therein.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same results are within the scope of this invention.

What is claimed is:

1. A metered dispensing cap system for containers, comprising:

a) a base element defined by an outer perimeter, said base element removably attachable to a squeezable container, the container having a squeezable sidewall portion and a top including an upwardly extending neck, and having an opening formed in said base element and an opening formed in the neck, said openings arranged in mutual axial alignment, for outflow of material from the squeezable container;

b) a one-way valve located in said base element at said aligned openings permitting flow of material from the squeezable container through said openings and preventing backflow thereof into the container; and, c) a meter element including:

i) a manually collapsible chamber formed of a thin, flexible chamber wall directly attached to said base element, about said perimeter thereof and covering over said one-way valve, to hydraulically seal said chamber from outside thereof, said chamber adapted to receive therein material squeezed from the container, through said one-way valve, and containment of the material therein; and, ii) an elongated spout communicably engaged at one end to said chamber and having a second, distal end spaced-apart therefrom for delivery of the material from said chamber upon manual collapsing of said chamber;

iii) wherein said chamber and said spout have a combined internal volume at least equal to the volume of the dose of material passed from the squeezable tube through said chamber and spout to the recipient of the material.

2. The metered dispensing cap system for containers of claim 1 wherein the neck of the squeezable container forms the upper frusto-conical end wall of the squeezable container and has formed externally thereabout a threaded boss, wherein the squeezable container is a collapsible tube, and wherein said base element includes a cap for threaded engagement with the threaded boss.

3. The metered dispensing cap system for containers of claim 1 wherein said aligned openings are centrally located in said base element and in the neck of the squeezable container.

4. The metered dispensing cap system for containers of claim 1 wherein said one-way valve comprises:

a) a shaft of terminal length received in said aligned holes in said base element and the opening formed in the top of the squeezable tube for reciprocal movement therein between said cap system and the squeezable container;

b) a valve head formed at the upper distal end of said shaft for movement away from said hole in said base element, to allow passage of material from the squeezable container into said chamber, and movement against said hole into sealing engagement with said base element, to prevent the backflow of material from said base element; and, c) a non-sealing fitting formed at the lower distal end of said shaft for retaining said shaft in said aligned holes when in the upper-most reciprocal position.

5. The metered dispensing cap system for containers of claim 1 wherein said chamber is bellows shaped and is collapsed by pressing down on top of said bellows toward said base element.

6. The metered dispensing cap system for containers of claim 1 wherein said chamber is hemispherical in shape and is collapsed by pressing down on said chamber wall toward said base element.

7. The metered dispensing cap system for containers of claim 1 wherein said spout is in communicable engagement with said chamber wall at said base element.

8. The metered dispensing cap system for containers of claim 1 wherein said spout is in communicable engagement with said chamber wall on said spherical wall.

9. The metered dispensing cap system for containers of claim 1 wherein said chamber is bellows shape and said spout is in communicable engagement therewith at said base element.

10. The metered dispensing cap system for containers of claim 1 wherein said chamber is bellows shape, having a top end and a bottom end and wherein said spout is in communicable engagement therewith at said top end of said bellows and extends outward and upward from said top end of said bellows, and said system further includes a pair of finger supports extending outward, one from each side of said bellows, a short distance for temporary receipt thereon of the index and middle fingers of the hand of the party inserting the material to be dispensed.

11. The metered dispensing cap system for containers of claim 1 further including a blank element removeably attachable to said base element, in place of the squeezable container following establishing a dose of material from the squeezable container, so that the dispensing cap system may be removed from the container and utilized elsewhere.

12. The metered dispensing cap system for containers of claim 11 wherein said blank element is threadably attached to said base element.

13. The metered dispensing cap system for containers of claim 11 wherein said blank element is attached to said base element by a snap fitting.

14. The metered dispensing cap system for containers of claim 1 wherein said one-way valve comprises a flap hingedly mounted over said opening in said base element, and biased closed thereover, that will bend upward toward said chamber when material is exuded from the squeezable container into said meter element and bend downward into sealing relationship with said base element when no further material is exuded into said chamber.

15. The metered dispensing cap system for containers of claim 1 wherein said elongated spout is made from a material that allows some bending of said spout during use.

16. The metered dispensing cap system for containers of claim 1 wherein said elongated spout member includes a flexible portion along its length allowing said spout to be bent out of straight alignment for application of the material inserted therein.

17. The metered dispensing cap system for containers of claim 1 further including a cap to fit over said distal end of said spout to prevent the escape of material therefrom.

18. The metered dispensing cap system for containers of claim 1 further including a baffle mounted in said chamber to direct the incoming material, from the container, and divert it from entrance into said spout.

19. A metered dispensing cap system for containers of medicinal salve, comprising:

a) a stiff base element of finite thickness and defined by an outer perimeter threadably attachable to the externally threads located about the neck of a collapsible tube of medicinal salve, and having an opening formed in said base element and an opening formed in the neck of the collapsible tube, said openings arranged in mutual axial alignment, for outflow of salve from the tube;

b) a one-way valve located in said base element at said aligned openings permitting flow of salve from the collapsible tube through said openings and preventing backflow thereof into the tube; and, c) a meter element comprising:

i) a manually collapsible chamber formed of a thin, flexible chamber wall directly attached to said base element, about said perimeter and covering over said one-way valve, to hydraulically seal said chamber from outside thereof, said chamber adapted to receive therein salve squeezed from the tube, through said one-way valve, and containment of the salve therein; and, ii) an elongated spout communicably engaged at one end to said chamber and having a second, distal end spaced-apart therefrom for delivery of the salve from said chamber upon manual collapsing of said chamber;

iii) wherein said chamber and said spout have a combined internal volume at least equal to the volume of the dose of medicinal salve passed from the tube through said chamber and spout to the recipient of the salve.

20. The metered dispensing cap system for tubes of claim 19 wherein said one-way valve comprises:

a) a shaft of terminal length received in said aligned holes in said base element and the opening formed in the top of the collapsible tube for reciprocal movement therein between said cap system and said squeezable tube;

b) a valve head formed at the upper end of said shaft for movement away from said hole in said base element, to allow passage of salve from the collapsible tube into said chamber, and movement against said hole into sealing engagement with said base element to block the backflow of salve from said base element; and, c) a non-sealing fitting formed at the lower end of said shaft for retaining said shaft in said aligned holes when in the upper-most position.

21. The metered dispensing cap system for containers of claim 19 further including a blank element for threading into said base element, in place of the collapsible tube, following establishing a dose of salve from the collapsible tube, so that the dispensing cap system may be removed from the tube and utilized elsewhere.

22. The metered dispensing cap system for containers of claim 19 further wherein said one-way valve comprises a flap hingedly mounted over said opening in said base element, and biased closed thereover, that will bend upward toward said chamber when salve is exuded from the tube into said meter element and bend downward into sealing relationship with said base element when no further salve exudes into said chamber.

23. The metered dispensing cap system for tubes of claim 19 wherein said chamber is spherical in shape, said spout is in communicable engagement therewith at said base element, and further including a small baffle located between said one-way valve and the joint between said chamber and said spout to prevent salve from prematurely running out of said chamber before said chamber is completely full of medicinal salve.

24. A metered dispensing cap system for containers of medicinal salve, comprising:

a) a stiff base element of finite thickness and defined by an outer perimeter and of finite thickness threadably attachable to the externally threads located on the neck of a collapsible tube of medicinal salve, and having an opening formed in said base element and an opening formed in the neck of the collapsible tube, said openings arranged in mutual axial alignment, for outflow of salve from the tube;

b) a one-way valve located in said base element at said aligned openings permitting flow of salve from the collapsible tube through said openings and preventing backflow thereof into the tube; and, c) a meter element comprising:

i) a manually collapsible chamber formed of a thin, flexible chamber wall directly attached to said base element, to hydraulically seal said chamber from outside thereof, about said perimeter and covering over said one-way valve, said chamber adapted to receive therein salve squeezed from the tube, through said one-way valve, and containment of the salve therein; and, ii) an elongated spout communicably engaged at one end to said chamber and having a second, distal end spaced-apart therefrom for delivery of the salve from said chamber upon manual collapsing of said chamber, wherein said spout member includes a flexible portion along its length.

iii) wherein said chamber and said spout have a combined internal volume at least equal to the volume of the dose of medicinal salve passed from the tube through said chamber and spout to the recipient of the salve.

* * * * *